US012145754B2

(12) United States Patent
Lelie et al.

(10) Patent No.: US 12,145,754 B2
(45) Date of Patent: Nov. 19, 2024

(54) DEVICE AND METHOD FOR PRODUCING BUNDLES OF INDIVIDUAL PACKAGES

(71) Applicant: KHS GmbH, Dortmund (DE)

(72) Inventors: Thomas Lelie, Kleve (DE); Bernd Cox, Weeze (DE); Michael Jörissen, Bedburg-Hau (DE)

(73) Assignee: KHS GmbH, Dortmund (DE)

( * ) Notice: Subject to any disclaimer, the term of this patent is extended or adjusted under 35 U.S.C. 154(b) by 269 days.

(21) Appl. No.: 17/630,332

(22) PCT Filed: Jul. 15, 2020

(86) PCT No.: PCT/EP2020/069947

§ 371 (c)(1),
(2) Date: Jan. 26, 2022

(87) PCT Pub. No.: WO2021/018581

PCT Pub. Date: Feb. 4, 2021

(65) Prior Publication Data

US 2022/0250776 A1 Aug. 11, 2022

(30) Foreign Application Priority Data

Aug. 1, 2019 (DE) ..... 102019120788.6

(51) Int. Cl.
*B65B 11/12* (2006.01)
*B65B 49/08* (2006.01)
(Continued)

(52) U.S. Cl.
CPC ..... *B65B 11/12* (2013.01); *B65B 49/08* (2013.01); *B65B 49/10* (2013.01); *B65B 49/14* (2013.01); *B65B 51/02* (2013.01)

(58) Field of Classification Search
CPC ..... B65B 11/004; B65B 11/08; B65B 11/10; B65B 11/12; B65B 11/16; B65B 11/42;
(Continued)

(56) References Cited

U.S. PATENT DOCUMENTS 466,120 A * 12/1891 McCombs ..... B65B 11/12 53/232
996,187 A * 6/1911 Wilson ..... B65B 11/12 198/606
(Continued)

FOREIGN PATENT DOCUMENTS

AT 77292 B 7/1919
DE 4118556 A1 12/1992
(Continued)

OTHER PUBLICATIONS

International Search Report, PCT Application No. PCT/EP2020/069947, mailed Jan. 11, 2021 (5 pages).

*Primary Examiner* — Robert F Long
*Assistant Examiner* — Eduardo R Ferrero
(74) *Attorney, Agent, or Firm* — Occhiuti & Rohlicek LLP

(57) ABSTRACT

An apparatus includes a folding unit and a transport unit that transports a package assembly on a transport plane towards the folding unit, the package assembly comprising containers that have been wrapped in a paper blank that comprises tabs that project past the containers. The tabs comprise a lower tab that is coplanar with the transport plane. The folding unit comprises a folding-device that folds lower tabs with plates arranged on both sides of the transport unit. The plates move with three degrees-of-freedom: along the transport unit, towards the package assembly, and perpendicular to the transport plane.

20 Claims, 3 Drawing Sheets

(51) Int. Cl.
*B65B 49/10* (2006.01)
*B65B 49/14* (2006.01)
*B65B 51/02* (2006.01)

(58) Field of Classification Search
CPC ..... B65B 49/08; B65B 49/10; B65B 49/14; B65B 51/02; B66F 7/065
USPC ..... 53/461, 466, 48.6, 48, 7, 48.8, 228, 232, 53/233, 48.7
See application file for complete search history.

(56) References Cited

U.S. PATENT DOCUMENTS 1,129,975 A * 3/1915 Girouid ..... B65B 11/16 53/222
1,350,608 A * 8/1920 Harriss ..... B65B 11/12 118/247
1,443,068 A * 1/1923 Conley ..... B65B 51/14 53/77
1,491,269 A * 4/1924 Joplin ..... B65B 11/12 53/461
1,556,187 A * 10/1925 Waterstone ..... B65B 11/12 53/372.6
1,575,723 A * 3/1926 Smith ..... B65B 11/22 53/136.3
1,626,379 A * 4/1927 Armstrong ..... B65B 11/08 53/210
1,674,408 A * 6/1928 Metcalf ..... B65B 11/12 53/372.5
1,677,924 A * 7/1928 Metcalf ..... B65B 11/12 53/232
1,807,709 A 6/1931 Sandberg
1,824,266 A * 9/1931 Haas ..... B65B 49/14 53/372.5
1,946,697 A * 2/1934 Johnson ..... B65B 11/12 53/234
1,968,190 A * 7/1934 Clark ..... B65B 51/02 118/62
2,009,613 A * 7/1935 Gerstein ..... B65B 51/02 118/59
2,251,671 A * 8/1941 Forst ..... B65B 49/14 53/210
2,486,892 A * 11/1949 Sumida ..... B65B 11/12 53/370.7
2,603,047 A * 7/1952 Malhiot ..... B65B 11/42 53/372.2
2,611,226 A * 9/1952 Harvey ..... B65B 49/10 53/372.4
2,675,657 A * 4/1954 Taggart ..... B65B 11/12 53/77
2,932,929 A * 4/1960 Fahrenbach ..... B65B 49/14 53/506
3,078,633 A * 2/1963 Stromberg ..... B65B 49/08 53/372.6
3,110,143 A * 11/1963 Schooler ..... B65B 11/12 53/220
3,213,591 A * 10/1965 Feurstein ..... B65B 11/22 53/76
3,237,364 A * 3/1966 Mack ..... B65B 11/12 53/526
3,287,882 A * 11/1966 Smith ..... B65B 49/08 53/76
3,553,935 A * 1/1971 Woods ..... B65B 11/58 53/209
3,611,675 A * 10/1971 Walter ..... B65B 11/12 53/224
3,681,893 A * 8/1972 De Barge ..... B65B 7/20 53/209
3,724,159 A * 4/1973 Reed ..... B65B 49/08 53/399
3,750,361 A * 8/1973 Stevens ..... B65B 11/12 53/461
3,763,629 A * 10/1973 Carlstrom ..... B65B 11/42 53/372.2
3,869,846 A * 3/1975 Timmerbeil ..... B65B 49/08 53/553
3,875,724 A * 4/1975 Langen ..... B65B 11/004 53/462
4,023,330 A * 5/1977 Williams ..... B65B 49/08 53/371.9
4,463,541 A * 8/1984 Nowacki ..... B65B 35/44 53/540
4,562,687 A * 1/1986 Green, Jr. ..... B65B 5/026 53/376.5
4,569,182 A * 2/1986 Leuvering ..... B65B 11/004 53/381.1
4,624,096 A * 11/1986 Nordstrom ..... B65B 51/16 53/590
4,730,443 A * 3/1988 Matsuda ..... B65B 49/14 53/252
4,953,344 A * 9/1990 Wallace ..... B65B 63/02 100/295
4,959,945 A * 10/1990 Rooyakkers ..... B65B 49/08 53/375.4
5,039,148 A * 8/1991 Brautovich ..... E01H 1/1206 294/1.3
5,056,294 A * 10/1991 Focke ..... B65B 11/08 53/201
5,228,273 A * 7/1993 Kovacs ..... B65B 49/06 493/182
5,353,575 A * 10/1994 Stepanek ..... B65D 85/505 53/399
5,410,862 A * 5/1995 Janhonen ..... B65B 25/14 53/215
5,437,144 A 8/1995 Akiyama et al.
5,502,954 A * 4/1996 Akiyama ..... B65B 49/08 53/76
5,570,563 A * 11/1996 Focke ..... B65B 49/14 53/372.5
5,775,064 A * 7/1998 Iwata ..... B65B 49/14 53/466
5,819,501 A * 10/1998 Albrecht ..... B65B 49/08 53/372.5
6,067,780 A * 5/2000 Gentili ..... B65B 25/146 53/376.2
8,534,033 B2 9/2013 Perreault et al.
9,266,632 B1 * 2/2016 Anderson ..... B65B 61/02
2002/0050128 A1 * 5/2002 Spatafora ..... B65B 19/225 53/461
2002/0116895 A1 * 8/2002 Antoniazzi ..... B65B 25/146 53/230
2006/0053751 A1 * 3/2006 Ito ..... B65B 51/14 53/463
2007/0240384 A1 * 10/2007 Boldrini ..... B65B 1/02 53/377.8
2008/0120948 A1 * 5/2008 Martin ..... B65B 49/14 53/491
2008/0142577 A1 * 6/2008 Pathak ..... B65D 5/40 229/122
2009/0183467 A1 * 7/2009 Rapp ..... B65B 49/14 53/370.2
2011/0139664 A1 * 6/2011 Ageling ..... B65D 71/08 53/147
2012/0085072 A1 4/2012 Deschenes
2012/0102885 A1 * 5/2012 Sharp ..... B65D 35/28 53/452
2014/0075890 A1 * 3/2014 Bruker ..... B65B 11/12 53/203
2014/0290178 A1 * 10/2014 Koster ..... B65B 59/003 53/580
2015/0183539 A1 * 7/2015 Cox ..... B65B 49/08 53/558
2016/0272353 A1 * 9/2016 Napravnik ..... B65B 35/30
2017/0197743 A1 * 7/2017 Jones ..... B65B 19/221

(56) References Cited

U.S. PATENT DOCUMENTS

| | | | | |
|---|---|---|---|---|
| 2018/0148203 | A1* | 5/2018 | Monti | B65B 49/14 |
| 2018/0222608 | A1 | 8/2018 | Hutter et al. | |

FOREIGN PATENT DOCUMENTS

| | | | |
|---|---|---|---|
| DE | 102008052633 | A1 | 4/2010 |
| EP | 1770014 | A2 | 4/2007 |

* cited by examiner

DEVICE AND METHOD FOR PRODUCING BUNDLES OF INDIVIDUAL PACKAGES

RELATED APPLICATIONS

This is the national stage of PCT/EP2020/069947, filed on Jul. 15, 2020, which claims the benefit of the Aug. 1, 2019 priority date of German application DE102019120788.6, the contents of which are incorporated herein by reference.

FIELD OF INVENTION

The invention relates to packaging containers and in particular, to bundling containers.

BACKGROUND

It is often the case that one buys liquid containers that have been bundled into a packaging unit using plastic film that has been shrunken by application of heat. The resulting tension in the package secures the containers against each other and creates a stable bundle.

Although the use of plastic film is quite effective, concerns have been raised concerning the sustainability of this practice. It has thus become necessary to find ways to bundle containers using paper and doing so in a way that stabilizes containers as well as shrink-wrapped plastic does.

SUMMARY

Taking this as a basis, the invention is based on the object of providing a device and a method for producing bundles formed as stable packaging units.

The invention relates to a device for producing bundles of individual packages, in particular liquid containers, by introducing a package assembly from grouped individual packages into a blank formed from a packaging material, with a folding unit for attaching tabs of the blank wrapping the package assembly, projecting over the package assembly transverse to a transport direction, to the package assembly, and a transport unit for conveying the package assembly along a transport plane through the folding unit.

The invention further relates to a method for producing bundles of individual packages, in particular liquid containers, by introducing a package assembly of grouped individual packages into a blank formed from a packaging material, with the steps of transporting the package assembly by means of a transport unit along a transport plane through a wrapping unit and a folding unit, wrapping the package assembly with the blank in the transport direction of the transport unit, and attaching tabs of the blank, projecting over the package assembly transverse to the transport direction, to the package assembly.

The device according to the invention for producing bundles of individual packages comprises a folding unit and a transport unit. The transport unit serves to transport the individual packages, such as beverage bottles or cans, grouped to form a package assembly and introduced into a blank from a paper material, hereinafter the paper blank, along a transport plane, provided, for example by a transport belt on which the package assembly stands upright, through the folding unit.

Before this, in a wrapping unit, upstream of the folding unit, the grouped individual packages are introduced into a blank of the paper material, located in the wrapping unit, in the transport direction of the transport unit. The tabs of the blank, projecting laterally, i.e. transverse to the transport direction, on both sides over the package assembly, are then brought in contact with the package assembly in the folding unit, in order to form a bundle that is closed on all sides.

In order to position the first lower tabs of the section of the paper blank, which are in contact with the underside of the package assembly, which, after the wrapping of the package assembly with the paper blank, are therefore arranged parallel to the transport plane, and, due to the package assembly standing upright on the transport belt forming the transport plane, are essentially arranged in the transport plane, the folding unit comprises a first folding device, which has folding plates arranged on both sides of the transport plane. The folding plates serve to bring the lower tabs of the paper blank, projecting over the package assembly, into contact laterally with the package assembly, wherein, for this purpose, the folding plates can be moved along the transport unit, can be brought into engagement with the lower tabs, can be moved in adjustment in the direction onto the package assembly, and can be displaced perpendicular to the transport plane and transverse to the transport direction.

The capacity for the movement of the folding plates in the transport direction along the transport unit allows for this to be adjusted in synchrony with the package assembly in the transport direction. During the adjacent adjustment movement of the folding plates in the transport direction to form the package assembly, the folding plates can be brought into engagement with the lower tabs and can be moved in the direction onto the package assembly. The adjustment movement is in this situation configured in such a way that, during the adjustment movement, the folding plates fold the lower tabs onto the package assembly, until the lower tabs are in full surface contact with the side surfaces of the package assembly. The movement capacity of the folding plates provided for according to the invention, perpendicular to the transport plane as well as transverse to the transport direction, allows for the folding plates to be moved perpendicular to the transport plane in the direction onto an upper side, related to the position of use, of the package assembly. Accordingly, when in contact with the folded lower tab, and by means of the folding plate, with such a displacement, the folded lower tab is moved in the direction onto an upper side of the package assembly, as a result of which a tensioning effect is exerted on the paper blank, from which there results a taut positioning of the lower tabs, and of the intermediate region of the blank running between the lower tabs, on the package assembly.

The configuration according to the invention of the folding unit with a first folding unit allows for a blank formed from a paper material to be arranged in a permissible manner with a lower tab taut on the package assembly, which is a precondition for a bundle configured as a stable packaging unit.

The configuration of the movement of the folding plates in the direction onto the side surfaces of the package assembly is in principle freely selectable, which can be achieved, for example, by guiding the folding plates along the transport device with changeable distance intervals. According to a further embodiment of the invention, provision is made for the folding plates to be capable of pivoting about a longitudinal axis aligned parallel to the transport direction, in the direction onto the package assembly. This configuration of the adjustment movement in the direction onto the package assembly ensures in a particular manner a reliable contact of the lower tabs with the package assembly. In addition to this, this adjustment can be carried out particularly easily and economically.

Contact of the other projecting tabs of the blank with the package assembly can, in principle, take place in any desired manner and sequence. According to one particularly advantageous embodiment of the invention, however, provision is made for the folding unit to comprise a second folding device for bringing in contact front and rear tabs, aligned perpendicular to the transport plane, with the lower tabs that are in contact with the package assembly. According to this embodiment of the invention, by means of the second folding device, contact of the front and rear tabs of the paper blank is established, that, after the conclusion of the wrapping process, project laterally over the package assembly, aligned perpendicular to the transport plane, with the lower tabs that are already folded onto the package assembly. The use of a second folding device ensures a reliable contact of the front and rear tabs on the package assembly, wherein, by the contact of the front and rear tabs, and by way of the folding, the lower tab that is already folded onto the package assembly is fixed in its position.

In order to finalize the bundle configured as a stable packing unit, it is necessary, as the last step, for the upper tabs of the paper blank, projecting laterally over the package assembly, to be folded onto the package assembly, wherein, after the completion of the wrapping process in the wrapping unit, the upper tabs project parallel and, according to the height of the individual package, at a distance interval laterally over the package assembly. The contact of the upper tabs can in this situation likewise take place in any desired manner. According to one particularly advantageous embodiment of the invention, however, provision is made the folding unit to comprise a third folding device for bringing the upper tabs, arranged essentially parallel to the transport plane and at a distance interval from it, in contact with the lower tabs, as well as the front and rear tabs, already laid on the package assembly.

According to this embodiment of the invention, the third folding device serves to apply the upper tabs over the lower tabs, which are already applied to the package assembly, as well as applying the front and rear tabs, such that, after the concluding of the folding process, by way of the third folding device, these cover the front and rear tabs, as well as the lower tabs. at least in sections. By means of the third folding device it is therefore possible to produce a bundle that is formed as a stable packaging unit. Due to the upper tabs being folded over the lower tabs, as well as over the front and rear tabs, this exhibits the advantage that when the bundle is transported standing upright, related to the individual packaging, any intermediate spaces are avoided, which could collect dirt in the form of a pocket on the side surfaces of the bundle.

In principle, the securing of the tabs to the package assembly, as well as to one another, can be effected in any desired manner. For example, the use of fixing units that apply adhesive strips is conceivable, which, following on from the folding processes carried out by the first, second, or third folding device, fix the respective tabs in their folded position.

According to one advantageous further embodiment of the invention, however, provision is made for the folding unit to comprise a first adhesive unit, which is configured so as to apply adhesive means onto the front and rear tabs in the contact region with the lower tab.

According to this embodiment of the invention, on both sides, before the folding of the front and rear tabs onto the lower tabs that are already in place on the package assembly, an adhesive is applied in the region of the contact surfaces of the front and rear tabs that can be brought into contact with the lower tabs. This fixes the front and rear tabs in their folded position on the lower tabs on the package assembly after the folding procedure has been carried out by the second folding unit.

According to a further embodiment of the invention, the folding unit comprises a second adhesive unit, which is configured such as to apply adhesive to the lower tabs as well as to the front and rear tabs in the contact region with the upper tabs. According to this embodiment of the invention, the second adhesive unit serves to provide an adhesive to the front and rear tabs folded onto the package assembly as well as onto the lower tabs in their contact region with the upper tabs which are to be folded down. In this situation, the second adhesive unit can be used as an alternative or as a supplement to the first adhesive unit, and, by fixing the upper tabs, serves the purpose of ensuring the stable arrangement of the tabs folded onto the package assembly.

In this situation, the use of both the first and second adhesive units is particularly advantageous, which to a particular degree allows for the production of a bundle configured as a stable packaging unit.

According to a further embodiment of the invention, the device further comprises a dispensing and application unit for a closure band, for the additional closure of the package assembly when completely introduced into the blank, using a closure band. The use of the dispensing and application unit, which can be configured so as to apply and/or wrap a closure band in the longitudinal direction as well as the transverse direction in relation to the transport direction, increases the stability of the bundle being produced in a supplementary manner, and therefore further contributes to the production of a stable packaging unit. The closure band can, in particular, with a solution which does not involve wrapping, be an adherent or adhesive band. Ideally, this is a made of a material which is environmentally friendly, can rot down, and/or is biologically degradable, wherein, ideally, at least in part regions, the closure band comprises self-adhesive contact surfaces.

The arrangement of the folding plate in the manner according to the invention, such that it can be adjusted both in the direction onto the package assembly as well as parallel to the side surface, can in principle be of any desired form. According to one particularly advantageous embodiment of the invention, however, provision is made for the folding plate to be mounted in an adjustable manner on a carriage which can be moved in the transport direction. According to this embodiment of the invention, a movement of the folding plate takes place in the transport direction of the package assembly by means of a carriage, which for this purpose can be moved in a suitable carrier system in the transport direction. A movement and positioning in the transport axis direction therefore takes place independently of the transport unit conveying the packaging assemblies. As a result of this, the reliability of the folding of the lower tab, incurred by the folding plate, is further increased. The carriage is also suitable for accommodating a linear drive, which can be configured such as to move the folding plate in the direction onto the package assembly and/or perpendicular to the transport plane as well as transversely to the transport direction.

The carriage can in this situation be connected securely to a transport belt or can also be moved by its own drive unit freely along a rail system. The free movement capability allows for the carrier to be adjusted individually, and therefore allows it to be adjusted in an optimum manner to the movement and position of the packaging assemblies on a transport belt of the transport unit.

According to a further embodiment of the invention, provision is further made for the folding plate to comprise an adherent coating in the contact region of the lower tab. Due to the adherent coating, the surface of the folding plate in the contact region with the lower tab of the paper blank exhibits an appropriate adherence friction coefficient, which, at the displacement of the folding plate transverse to the transport direction and parallel to the side surfaces of the folding plate, ensures in a particular manner a movement of the lower tab in the displacement direction of the folding plate. As a result of this, in a particularly advantageous manner an adequate degree of tension can be exerted onto the paper blank by way of the lower tabs, such that a particularly taut contact of the paper blank, in particular in the region between the lower tabs.

According to the method according to the invention for producing bundles of individual packages, in particular liquid containers, by introducing a package assembly of grouped individual packages into a blank of a packaging material, transport of the package assembly takes place along a transport plane through a wrapping unit and a folding unit. In the wrapping unit, the package assembly is introduced into the blank which is present in the transport direction of the transport unit, wherein, after the introducing of the package assembly transverse to the transport direction, tabs of the blank project over the side edges of the package assembly. These tabs are then brought in contact on the package assembly, wherein the tabs are folded by means of a folding unit along the edges of the package assembly in the direction onto the side faces of the package assembly.

Characteristic of the method according to the invention is the use of a blank made of a paper material, hereinafter the paper blank, wherein the tabs of the paper blank projecting laterally over the package assembly are brought in contact with the package assembly in the following sequence. In a first step, the lower tabs, arranged essentially parallel to the transport plane and arranged in it, are brought in contact with the package assembly, wherein the lower tabs, related to the position of use, are moved upwards onto the package assembly. In a further step, the front and rear tabs of the paper blank, aligned perpendicular in relation to the transport plane, are brought in contact with the lower tabs already in contact with the package assembly. In a subsequent step, the upper tabs, arranged essentially parallel to the transport plane and at a distance interval from it, are brought in contact with the lower tabs as well as with the front and rear tabs, already in contact on the package assembly, wherein, related to the position of use, the upper tabs are folded downwards.

The folding sequence of the tabs according to the invention ensures, in the upright positioning of the bundle in relation to the packed individual packages, that no pockets in the side surfaces of the package assembly, which open upwards and could catch dirt, are formed by the pockets attached to the package assembly. As well as this, the folding sequence according to the invention ensures a bundle that is formed as a stable packaging unit.

The securing of the tabs to one another can in principle take place in any desired manner. According to one advantageous further embodiment of the invention, however, provision is made for an adhesive to be applied in the contact region with the lower tabs before the front and rear tabs are brought in contact. In principle, the adhesive is applied in this situation on the region of the lower tabs which comes in contact with the front and rear tabs. In a particularly advantageous manner, however, provision is made for the adhesive to be applied to the regions of the front and rear tabs which can be brought in contact with the lower tabs, as a result of which it is ensured in a particularly reliable manner that the folded front and rear tabs are provided with adhesive in the contact region, and fixing of the front and rear tabs to the lower tabs then takes place.

According to a further embodiment of the invention, provision is further made for the lower tabs and/or the front and rear tabs and/or upper tabs, in contact with the package assembly, to be drawn in the direction of their free ends. According to this embodiment, when the tabs come in contact with the package assembly, in addition to a purely folding movement, a movement of the tabs also takes place in the direction of their free ends, as a result of which these are attached tautly to the package assembly. The tension applied to the tabs also increases the tension in the region between the pre-tensioned tabs, such that an overall taut arrangement of the packaging material in the package assembly is achieved. A movement of the tabs in the direction of their free end can be achieved, for example, by a corresponding relative movement of the folding means of the folding unit, wherein, for particular preference, these comprise, in their contact region with the tabs, a surface condition which ensures a good adherence between the folding means and the tabs.

The securing of the upper tabs finally attached to the package assembly can likewise in principle be effected in any desired manner. In a particularly advantageous manner, however, provision can be made that, before the attachment of the upper tabs, an adhesive is applied in the contact region with the lower tabs as well as with the front and rear tabs. The use of an adhesive ensures a securely located arrangement of the tabs in contact with the package assembly, such that the formation of a bundle configured as a stable packaging unit is ensured in a particularly reliable manner. The adhesive which can be used to connect the lower tabs as well as the front and rear tabs can in this situation be applied in both the contact region with the upper tabs onto the lower tabs as well as onto the front and rear tabs, as well as directly onto the upper tabs.

According to a further embodiment of the invention, provision is made that, after the concluding of the attachment of the tabs to the package assembly, this can be closed by a closure band or completely wrapped for closure, as described heretofore. This band can be arranged on the package assembly both in the transport direction as well as transverse to the transport direction, and provides additional stability for the bundle.

In principle, the production of a bundle of individual packages can be carried out by introduction of the grouped individual packages into the packing material. According to one advantageous further embodiment of the invention, however, provision is made for the package assembly to be arranged on a carrier, in particular a tray made of board material, before being introduced into the paper blank. The use of a tray made of board material increases the position security of the individual packages in relation to one another and improves the stability of a bundle produced with the use of the method according to the invention.

BRIEF DESCRIPTION OF THE DRAWINGS

These and other features of the invention will be apparent from the following detailed description and the accompanying figures, in which.

DETAILED DESCRIPTION

Figure 1:
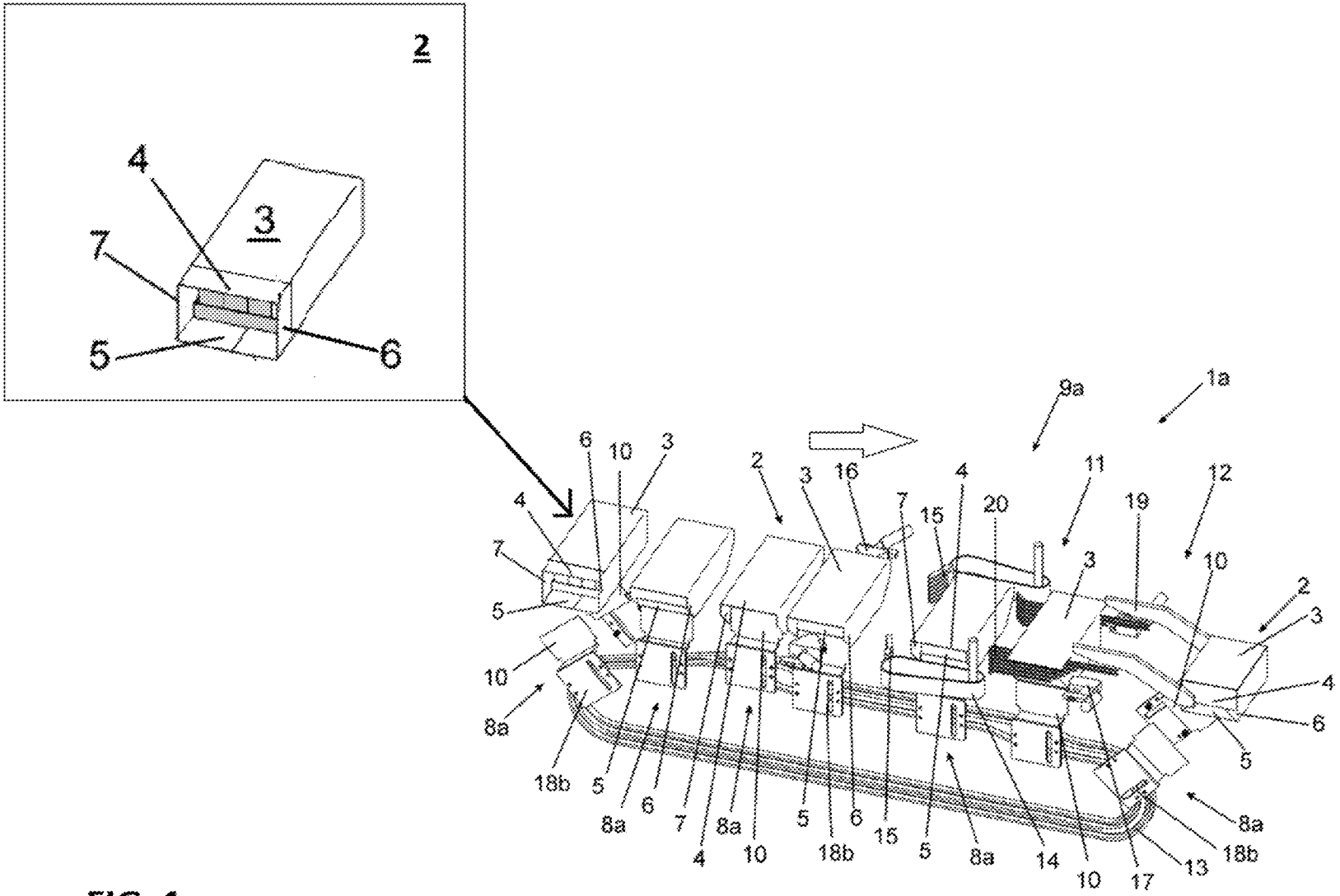
FIG. 1 is a perspective view of a first device for producing bundles of individual packages.

FIG. 1 shows a bundling machine 1*a* for bundling packages to form a package assembly 2. The bundling machine 1*a* comprises a transport unit having a belt 13 that moves a package assembly 2 through a folding unit 9*a* in a transport direction.

As shown in FIG. 1, the packages arrive after having already been wrapped in a paper blank 3 by an upstream wrapping unit. However, although the package has been wrapped, it has not yet been folded. As a result, the paper blank 3 still has upper tabs 4, lower tabs 5, front tabs 6, and rear tabs 7 that project laterally beyond the package assembly 2 in a direction that is transverse to the transport direction. To actually complete the process of forming a bundle, the upper tabs 4, lower tabs 5, front tabs 6, and rear tabs 7 must all be folded and attached to the package assembly 2. These operations are carried out by a folding unit 9*a* that includes a first folding device 8*a*, a second folding device 11, and a third folding device 12.

The first folding device 8*a* attaches the lower tabs 5 to the package assembly 2. It does so by using folding plates 10 that are arranged on a carriage 18*a* that moves along a conveyor belt 13. As the package assembly 2 moves through the folding unit 9*a*, each folding plate 10 comes into engagement with a corresponding lower tab 5. The movement path of the carriage 18*a* matches that of the package assembly 2 along its transport plane in such a way that, as the folding plate 10 moves in the transport direction, it engages the lower tab 5 and folds it into contact with the package assembly 2 by moving it in a direction towards the package assembly 2.

Because of the route followed by the conveyor belt 13, the folding plate 10 also moves vertically relative to the transport plane. This draws the lower tab 5 in a direction onto the upper side. Following this, the route followed by the conveyor belt 13 dips slightly downward, thus causing the folding plate 10 to move vertically downwards. This partially releases the lower tab 5. It also allows a first adhesive unit 16 to apply adhesive onto the inner sides of the front tabs and rear tabs 7.

The package assembly 2 continues into a second folding device 11. The second folding device 11 folds the front and rear tabs 7. It does so while the folding plate 10 maintains contact with part of the lower tab 5 in the direction onto the package assembly 2 in such a way that the front and rear tabs 7 come in contact with the folded lower tab 5.

The second folding device 11 includes moving combs 15 and stationary combs 20. The moving combs 15 are carried by a transport belt 14 in the transport direction of the package assembly 2. As they move, the moving combs 15 press the rear tabs 7 onto the package assembly 2. Meanwhile, the stationary combs 20 bring the front tabs 6 into contact with the package assembly 2 as a result of the package assembly's continued movement in the transport direction.

In a last folding step, the upper tabs 4 come in contact with the lower tabs 5, front tabs 6, and rear tabs 7. Before the upper tabs 4 are folded, a second adhesive unit 17 applies adhesive to those regions of the front, lower, and rear tabs 5, 6, 7 that are to come into contact with the lower tabs 4.

A third folding device 12 brings stationary guide plates 19 into engagement with the upper tabs 4 to fold them. The guide plates 19 are shaped and arranged in such a way that, as the package assembly 2 continues to move in the transport direction, the upper tabs 4 come into engagement with the guide plates 19, which then draw the upper tabs 4 over the sides of the package assembly 2.

Figure 2:
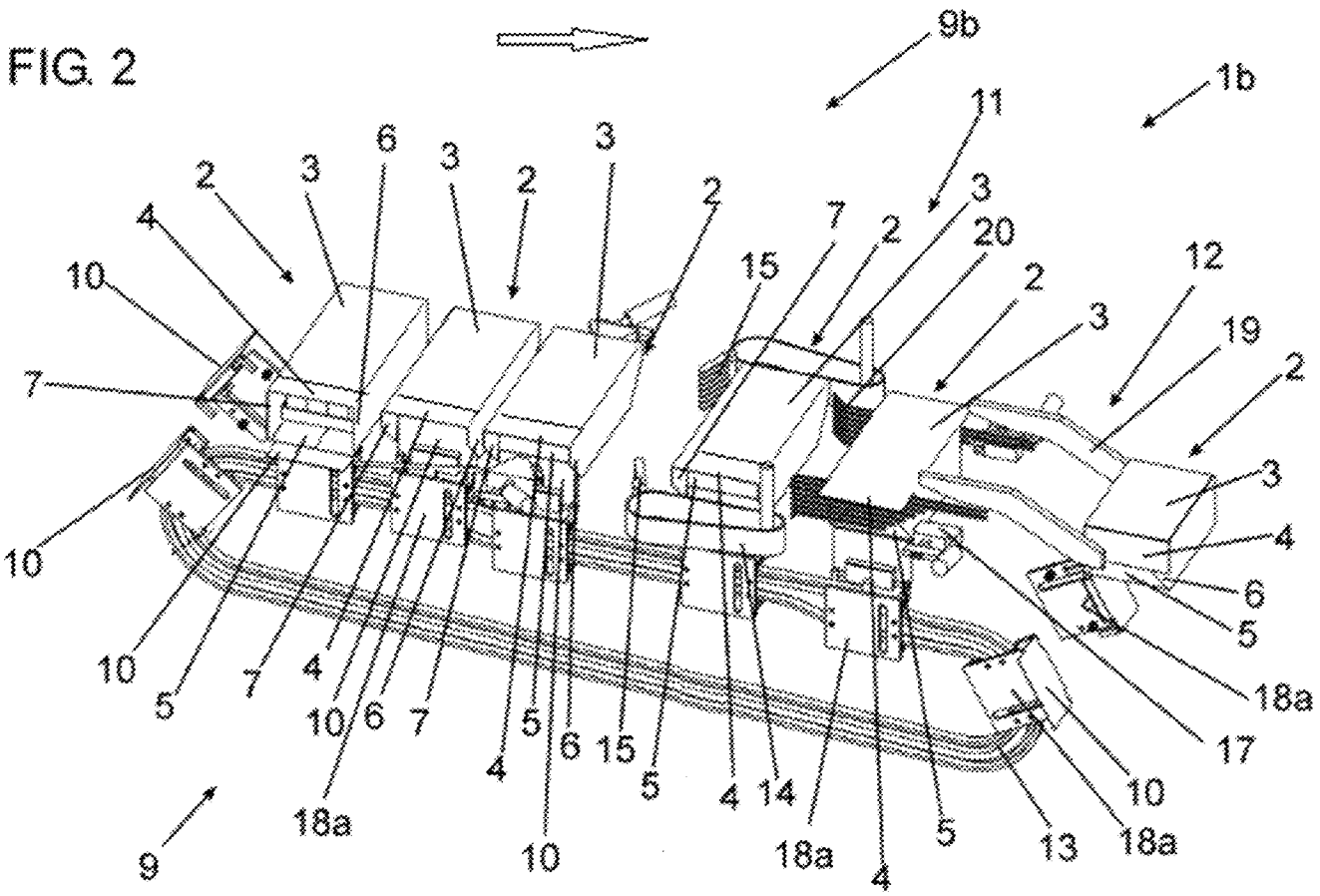
FIG. 2 is a perspective view of a second embodiment of a device for producing bundles of individual packages.

In an alternative folding unit 9*b*, which can be seen in FIG. 2, the folding plate 10 pivots about a longitudinal axis that is oriented in a direction parallel to the transport direction. This can be seen in FIG. 2 by comparing the orientation of the leftmost plate 10 in the figure with that of the plate 10 to its right.

The connection between the carriage 18*b* and the plate 10 that rides with the carriage 18*b* is configured such that a linear drive can move the folding plate 10 relative to the carriage 18*b* in a direction that is parallel to the sides of the package assemblies 2 as well as perpendicular to the transport plane. The lower tabs 5 are then folded by pivoting the folding plate 10 towards the sides of the package assembly 2 and vertically adjusting the folding plate 10 to cause tension on the lower tab 5. The remaining tabs, i.e., the front tab 6, the rear tab 7, and the upper tab 4, are folded in a manner similar to that shown in FIG. 1.

Figure 3:
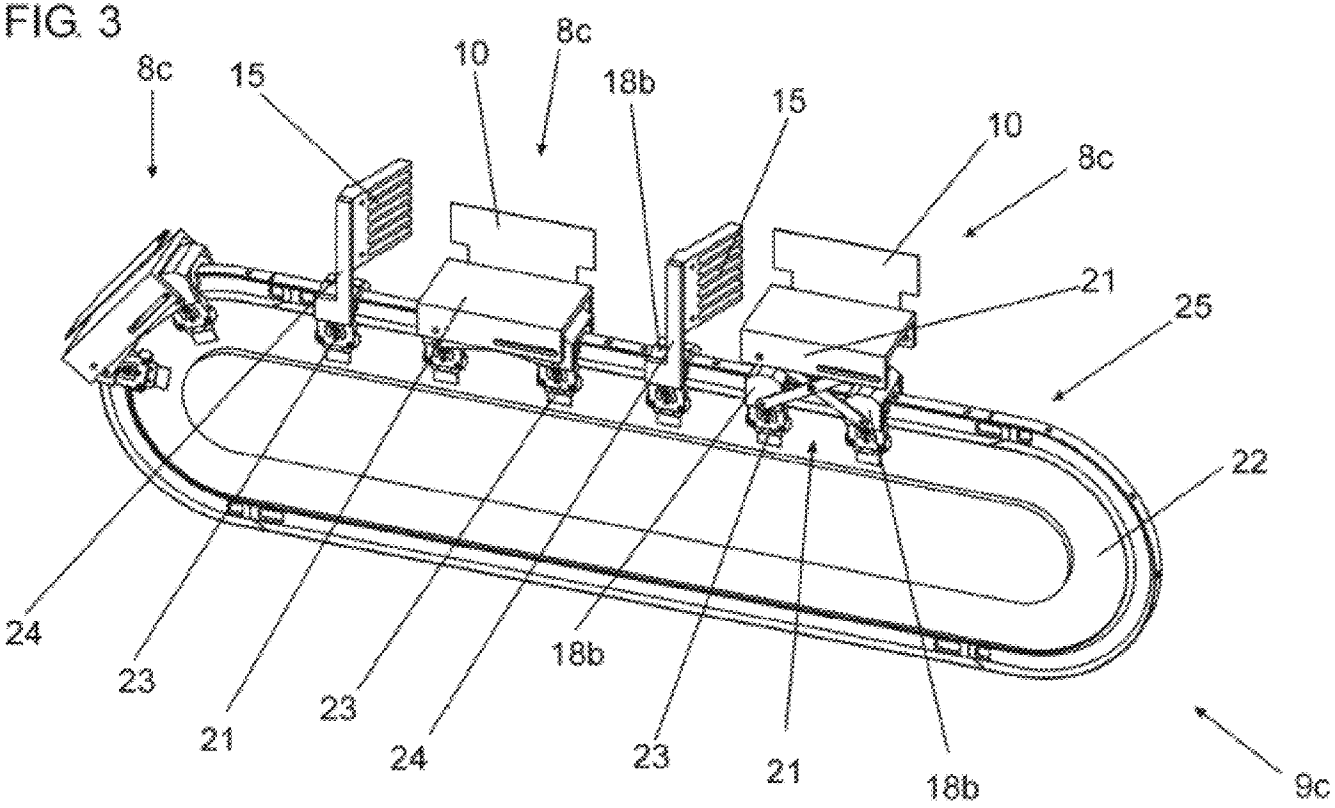
FIG. 3 is a perspective view of a first part of a folding unit for a device for producing bundles of individual packages.

FIG. 3 shows a transport system 25 for the carriages 18*b* of a second alternative folding unit 9*c*. An identical transport system 25 is present on the other side of the transport unit.

The transport system 25 includes a rail 22 upon which carriages 18*b* travel. Each carriage 18*b* has its own individual-actuatable drive 23 for enabling it to move independently of other carriages 18*b*. The carriages 18*b* are freely programmable so as to accommodate folding of package assemblies 2 that are distributed in different ways.

To fold a lower tab 5, the first folding device 8*c* of the folding unit 9*c* comprises two carriages 18*b* that are connected to a folding plate 10 by a scissor drive 21. The scissor drive 21 allows for a vertical adjustment of the folding plate 10, which is also pivotable in the manner shown in FIG. 2.

To fold the rear tabs 7, some of the carriages 18*b* carry a support 24 that supports a moving combs 15. The moving combs 15 folds the rear tabs 7 in the manner described in connection with FIG. 1.

The invention claimed is:

1. An apparatus for forming a package assembly that comprises containers that have been wrapped in a paper blank that comprises tabs that project past said containers, wherein said tabs comprise a lower tab that is coplanar with a transport plane along which said package assembly is moved, said apparatus comprising a folding unit and a transport unit that transports said package assembly on said transport plane towards said folding unit, wherein said folding unit comprises a first folding-device for folding said lower tab, said first folding-device comprising plates for folding said lower tab, said plates being arranged on both sides of said transport unit, wherein said plates are movable along said transport unit, wherein said plates are adjustable so as to be brought into engagement with said lower tab by movement towards said package assembly, and wherein said plates are displaceable in a direction that is perpendicular to said transport plane, said apparatus further comprising a scissors drive that allows for vertical displacement of the plates and enables said plates to be pivotable about a longitudinal axis aligned parallel to said transport direction.

2. The apparatus of claim 1, wherein said tabs further comprise front and rear tabs that are perpendicular to said transport plane and wherein said folding unit comprises a second folding-device that brings said front and rear tabs into contact with said lower tab.

3. The apparatus of claim 1, wherein said tabs comprise front and rear tabs that are perpendicular to said transport plane and an upper tab that is parallel to and above said transport plane and wherein said folding unit comprises a second folding-device that brings said front and rear tabs into contact with said lower tab and a third folding device that brings said upper tab into contact with said lower tab, with said front and rear tabs, and with said package assembly after said lower tab has been folded.

4. The apparatus of claim 1, wherein said tabs further comprise front and rear tabs that are perpendicular to said transport plane and wherein said apparatus further comprises a first adhesive unit that is configured to apply adhesive onto regions of said front and rear tabs that are to be in contact said lower tab.

5. The apparatus of claim 1, wherein said tabs comprise front and rear tabs that are perpendicular to said transport plane and an upper tab that is parallel to and above said transport plane, wherein said apparatus further comprises a first adhesive unit that is configured to apply adhesive onto regions of said front and rear tabs that are to contact said lower tab and a second adhesive unit that is configured to apply adhesive onto said lower tab as well as onto said front and rear tabs at those regions that are to contact said upper tab.

6. The apparatus of claim 1, further comprising a dispensing and application unit for a closure band for providing additional closure and/or wrapping of said package assembly with a closure band when completely introduced into said blank.

7. The apparatus of claim 1, wherein said plates comprise adhesive coatings in contact regions with said lower tab.

8. The apparatus of claim 1, wherein said plates are displaceable along said direction.

9. The apparatus of claim 1, wherein said plates move independently of said transport unit.

10. An apparatus for forming a package assembly that comprises containers that have been wrapped in a paper blank that comprises tabs that project past said containers, wherein said tabs comprise a lower tab that is coplanar with a transport plane along which said package assembly is moved, said apparatus comprising a folding unit and a transport unit that transports said package assembly on said transport plane towards said folding unit, wherein said folding unit comprises a first folding-device for folding said lower tab, said first folding-device comprising plates for folding said lower tab, said plates being arranged on both sides of said transport unit, wherein said plates are movable along said transport unit, wherein said plates are adjustable so as to be brought into engagement with said lower tab by movement towards said package assembly, wherein said plates are displaceable in a direction that is perpendicular to said transport plane, said apparatus further comprising a carriage that moves in said transport direction, wherein said plates for folding are adjustably mounted on said carriage, wherein said carriage has a connection with said plates, wherein said connection comprises means for enabling said plates to move relative to said carriage in a direction that is parallel to sides of said package assembly and perpendicular to said transport plane.

11. The apparatus of claim 10, wherein said tabs further comprise front and rear tabs that are perpendicular to said transport plane and wherein said folding unit comprises a second folding-device that brings said front and rear tabs into contact with said lower tab.

12. The apparatus of claim 10, wherein said tabs comprise front and rear tabs that are perpendicular to said transport plane and an upper tab that is parallel to and above said transport plane and wherein said folding unit comprises a second folding-device that brings said front and rear tabs into contact with said lower tab and a third folding device that brings said upper tab into contact with said lower tab, with said front and rear tabs, and with said package assembly after said lower tab has been folded.

13. The apparatus of claim 10, wherein said tabs further comprise front and rear tabs that are perpendicular to said transport plane and wherein said apparatus further comprises a first adhesive unit that is configured to apply adhesive onto regions of said front and rear tabs that are to be in contact said lower tab.

14. The apparatus of claim 10, wherein said tabs comprise front and rear tabs that are perpendicular to said transport plane and an upper tab that is parallel to and above said transport plane, wherein said apparatus further comprises a first adhesive unit that is configured to apply adhesive onto regions of said front and rear tabs that are to contact said lower tab and a second adhesive unit that is configured to apply adhesive onto said lower tab as well as onto said front and rear tabs at those regions that are to contact said upper tab.

15. The apparatus of claim 10, further comprising a dispensing and application unit for a closure band for providing additional closure and/or wrapping of said package assembly with a closure band when completely introduced into said blank.

16. The apparatus of claim 10, wherein said plates comprise adhesive coatings in contact regions with said lower tab.

17. The apparatus of claim 10, wherein said plates are displaceable along said direction.

18. The apparatus of claim 10, wherein said plates move independently of said transport unit.

19. A method comprising producing a bundle of individual liquid containers by introducing a package assembly in which a group of liquid containers is wrapped in a paper blank, wherein producing said bundle comprises using a transport unit to transport said package assembly in a transport direction along a transport plane through a wrapping unit and a folding unit, using a carriage that moves in said transport direction to carry out the steps of wrapping said package assembly with said blank, thereby forming tabs that project over said package assembly in a direction transverse to said transport direction, and attaching said tabs to said package assembly, wherein said tabs include a lower tab that is coplanar with said transport plane, front and rear tabs that are perpendicular to said transport plane, and an upper tab that is parallel to and above said transport plane, wherein attaching said tabs comprises bringing said lower tab into contact with said package assembly, bringing said front and rear tabs into contact with said lower tab and in contact with said package assembly, and bringing said upper tab into contact with said lower tab, said front and rear tabs, and said package assembly, said carriage having a connection with a folding plate that is adjustably mounted on said carriage, wherein said connection comprises means for enabling said folding plate to move relative to said carriage in a direction that is parallel to sides of said package assembly and perpendicular to said transport plane.

20. The method of claim 19, further comprising, prior to said blank being introduced, arranging said package assembly onto a tray made of a board material.

* * * * *